United States Patent [19]

Gengenbach et al.

[11] Patent Number: 4,644,118

[45] Date of Patent: Feb. 17, 1987

[54] ELECTRIC POWER CIRCUIT BREAKER

[75] Inventors: Bruno Gengenbach; Roland Michal; Jens Radbruch, all of Pforzheim, Fed. Rep. of Germany

[73] Assignee: Doduco Kg. Dr. Eugen Durrwachter, Pforzheim, Fed. Rep. of Germany

[21] Appl. No.: 718,524

[22] Filed: Apr. 1, 1985

[30] Foreign Application Priority Data

Apr. 5, 1984 [DE] Fed. Rep. of Germany ..... 3412824

[51] Int. Cl.[4] ..... H01H 33/04

[52] U.S. Cl. ..... 200/144 R; 200/148 C

[58] Field of Search ..... 200/144 C, 148 A

[56] References Cited

U.S. PATENT DOCUMENTS

| | | | |
|---|---|---|---|
| 3,586,802 | 6/1971 | Nichols et al. | 200/144 C |
| 4,368,367 | 1/1983 | Roth et al. | 200/148 A |
| 4,553,008 | 11/1985 | Veverka et al. | 200/148 R |

FOREIGN PATENT DOCUMENTS

| | | | |
|---|---|---|---|
| 782038 | 4/1968 | Canada | 200/144 C |

*Primary Examiner*—Robert S. Macon

*Attorney, Agent, or Firm*—Balogh, Osann, Kramer, Dvorak, Genova & Traub

[57] ABSTRACT

The power circuit breaker particularly for use in medium-voltage switchgear comprises contacting parts consisting of a contact pin, which is displaceable in the direction of its longitudinal axis, and a contact socket, which is coaxial to said pin and comprises a forward portion adapted to contact the pin. That forward portion of the socket is formed with axial slots dividing that forward portion into axial segments. Each of said segments comprises at its tip a covex portion, which protrudes radially inwardly and resiliently bears on the pin when the breaker is closed. In such breaker the pin has a forward portion, which comprises a tip and which has a length that is smaller than the largest depth to which the pin can be inserted into the socket. That forward portion consists of a composite material, which contains a metal having a high electrical conductivity and a material which releases quenching gases under the action of an electric arc. At least when the breaker is closed the pin and the socket are preferably surrounded by a sleeve for directing the flow of the quenching gases.

18 Claims, 12 Drawing Figures

FIG. 1
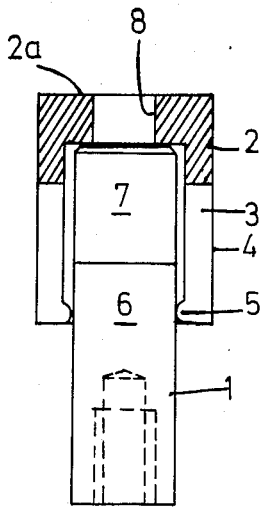
FIG. 2
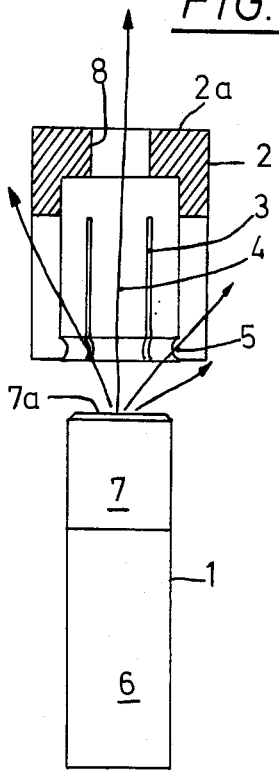
FIG. 3
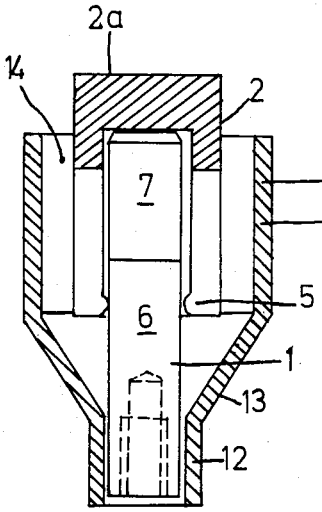
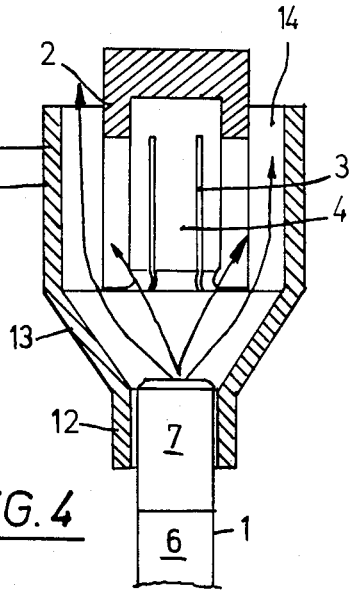
FIG. 4

FIG. 8
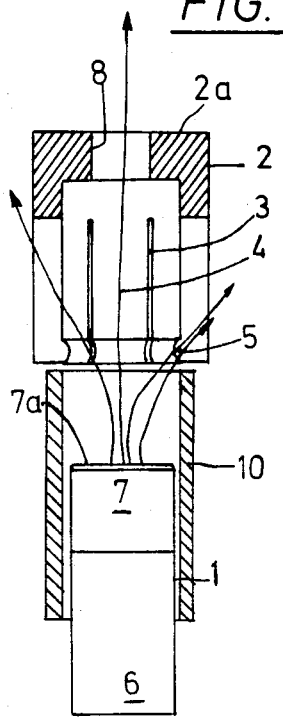
FIG. 9
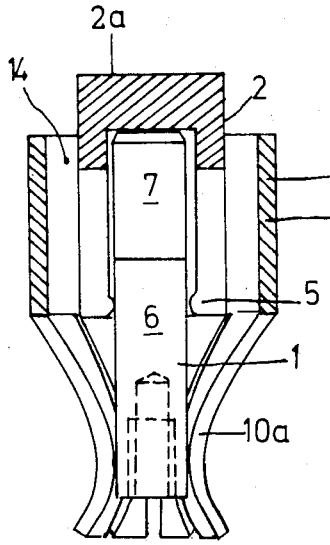
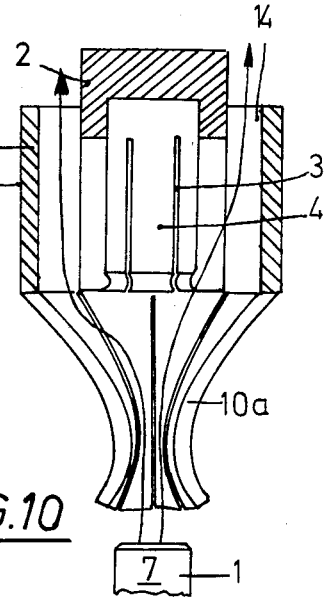
FIG. 10

FIG. 11
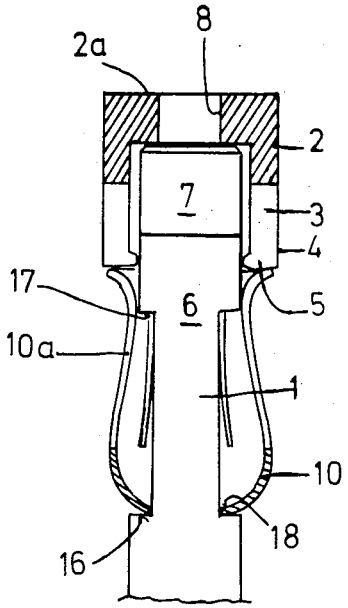
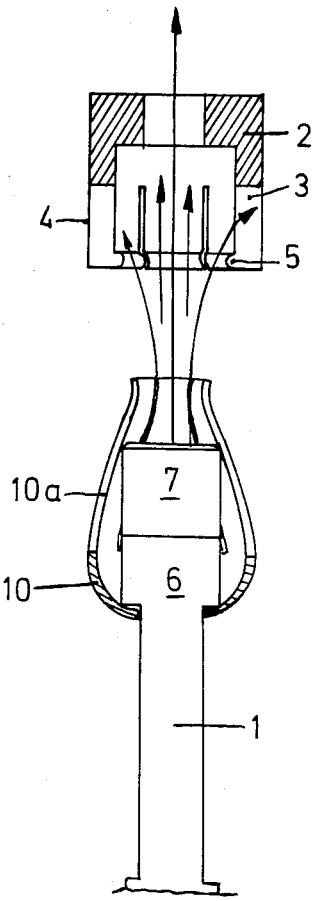
FIG. 12

ELECTRIC POWER CIRCUIT BREAKER

BACKGROUND OF THE INVENTION

1. Field of the Invention

This invention relates to an electric power circuit breaker, particularly for use in medium-voltage switchgear, which breaker comprises contacting elements consisting of a contact pin, which is displaceable in the direction of its longitudinal axis, and a contact socket, which is coaxial to said pin and has a forward portion that is adapted to contact the pin and divided by axial slots into axial segments, each of which is formed at its tip with a radially inwardly projecting, convex portion for resiliently contacting the pin.

2. Description of the Prior Art

When the two contacting elements of known switches of the kind outlined above are separated under load, an electric arc is usually struck and must be quenched. It is known that an electric arc can be quenched by the provision of parts of hard gas material close to the contact socket and contact pin. The term hard gas material describes a material which under the action of an electric arc releases mainly hydrogen and possibly also CO and electronegative gases, by which the electric arc is quenched. Such breakers are known as hard gas breakers. But the arc-quenching performance of such breakers is unsatisfactory in some load ranges, for instance when transformers are disconnected under no load so that they carry only low currents, or when currents of an order of 1 kA are to be interrupted.

SUMMARY OF THE INVENTION

It is an object of the invention to provide an electric power circuit breaker which is particularly suitable for use in medium-voltage switchgear and has a good arc-quenching performance.

In an electrical power circuit breaker of the kind outlined first hereinbefore that object is accomplished in that the pin comprises a forward end portion which is formed with a tip and has a length that is smaller than the depth to which the pin can be inserted into the socket, said forward end portion consists of or is coated with a composite material, and said composite material comprises a metal having a high electrical conductivity and a material which under the action of an electric arc releases quenching gases for cooling the electric arc.

The depth to which the pin can be inserted into the socket is the length of that portion of the pin which extends inside the socket beyond the convex portions of the segments of the socket when the pin has been inserted as far as to an end position in which said convey portions contact the pin.

Those components of such composite materials which can release arc-quenching gases may mainly consist of plastics, particularly of hardenable single-component and two-component resins, epoxy resins, phenolic resins, urea resins, melamine resins and silicone resins, or of synthetic thermoplastics which can be mixed with fillers. Examples of such thermoplastics are polyamides, polypropylene, polyethylene terephthalate, polybutylene terephthalate and polyacetals.

The composite material is electrically conductive because it contains particularly silver or copper or nickel or iron or alloys of said metals.

To make such composite materials the metal which renders the composite material electrically conductive is introduced in the form of a powder into the material which can release quenching gases and both materials are combined to form a solid body in which the material for releasing quenching gases constitutes a binder.

Owing to the provision of such composite material, which is disposed at the tip of the contact pin, and which will release quenching gases under the action of an electric arc, the electric arc which will be struck between the socket and the pin as the pin is retracted out of the socket to open the switch will have one end in direct contact with that composite material so that the quenching gases will be produced at the very point at which they are needed so that they can very quickly quench the electric arc. The quenching gases contain hydrogen as a component which is essentially required for the quenching of the electric arc and which owing to its high diffusion rate will effectively cool the electric arc as long as it exists and which during the current crossover (of alternating currents) will cool also the plasma produced by the electric arc and will prevent a re-striking of the electric arc. Carbon dioxide and oxygen may be present in addition to and may contribute to the cooling of the electric arc.

Another advantage resides in that the quenching gases emerge from the contact pin mainly at its end face which faces the socket, and that they flow adjacent to the electric arc toward the socket at a higher velocity than in known hard gas breakers. The higher velocity of the quenching gases will result in a more effective cooling of the electric arc and will promote a rapid extinction of the electric arc.

Part of the quenching gases may enter the socket and may leave the socket through the slots by which the forward portion of the socket is divided into axial segments.

Because the composite material which releases quenching gases is provided at the tip of the contact pin, the flow of the quenching gases will be directed so that any soot particles entrained by said gases will not be distributed over large regions of the switchgear, as in known hard gas breakers, but will be deposited mainly in a closely restricted region so that the undesired results of such deposition residing in a reduction of the electric strength can be controlled and will be less severe than in the prior art.

The quenching gases which enter the socket owing to their directed flow can leave the socket through its axial slots so that the socket may be closed at its rear end. For the generation of a directed flow of the quenching gases, particularly in a direction which is parallel to the socket, it may be desirable, however, to form the socket with an axial through bore so that the quenching gases can flow axially through the socket. Such an arrangement will also promote a rapid discharge of the quenching gases from the breaker.

A closely confined, directed flow of the quenching gases will be generated in a particularly desirable manner if the socket is surrounded at least in part of its length by a sleeve which is fixed to the socket and protrudes beyond the tip of the socket to such an extent that the sleeve encloses the forward portion of the pin even when the latter is in a rear end position in which it is retracted from and clear of the socket. That sleeve should be spaced around the socket with a clearance so that the socket and the sleeve define between them an annular passage, which is flown through by the quenching gases as the switch is opened. That sleeve will compel the gases to flow mainly parallel to the axis and will restrict the flow area so that the quenching gases will flow at a high velocity and will be strongly blown against the electric arc and be distributed along the arc column and the electric arc will be effectively cooled. The positive guidance of the flowing gases by such sleeve will also restrict the deposition of soot to small regions in which such deposition is not critical. The sleeve has a forward portion which surrounds the forward portion of the pin when the latter has been fully retracted and that forward portion of the sleeve has an inside diameter which is only slightly larger than the outside diameter of the pin. (The end position to which the pin can be retracted is defined, e.g., by a stop provided in the breaker. Just as the contact socket and possibly the preferably provided sleeve, that stop is provided in the breaker in a fixed position and limits the displacement of the pin away from the socket.). In such an arrangement the elektric arc which is struck between the pin and the socket as said two parts are separated will contact the pin only at its forward portion, which comprises the material which generates the quenching gases. Specifically, one end of the electric arc will contact the pin at its end face facing the socket. The electric arc cannot shift back to a pin portion which does not comprise the composite material for releasing quenching gases. Because the sleeve is closely spaced around the pin, as the switch is opened the arc can contact the pin only on the composite material containing the gas-releasing material. On the other hand, that composite material will not carry an electric current continuously because the pin will be inserted into the socket to a depth which exceeds the length of that portion which comprises the composite material containing the material which releases quenching gases.

The cooling of the arc column can also be intensified in that a sleeve is provided in front of the socket so as to surround only the axially displaceable pin and is arranged to contain the tip of the pin when the switch has been opened. Such a sleeve will then act like a nozzle for guiding the quenching gases along the arc column.

Regardless of whether a sleeve for guiding the quenching gases surrounds only the pin when it has been advanced i.e., when the switch is closed, or whether the sleeve surrounds also the socket, it will be desirable for an intense cooling of the arc column to provide such a sleeve which will automatically reduce its cross-section in the region between the socket and the pin as the latter is retracted from the socket so that the velocity of flow of the quenching gases in that region will be increased as by a venturi. Such a decrease in cross-section will be effected if the sleeve is formed with axial slits extending from one end of the sleeve in part of its length so that the sleeve comprises an annular series of resilient fingers, which resilient bear on the pin when the breaker is closed but slip from the contact pin as it is retracted and then spring radially inwardly. Such a sleeve may be fixed to the socket or may be mounted on the contact pin for a lost motion relative to the latter.

The arc-quenching performance of a circuit breaker in accordance with the invention will be further improved if the sleeve for guiding the quenching gases is made of or at least coated on the inside with a material which will also release quenching gases under the action of an electric arc, i.e., if the sleeve comprises materials which are used in known hard gas switches.

Owing to the guidance effected by the sleeve, the quenching gases will flow mainly in an axial direction. The quenching action of that flow will be promoted if the sleeve is formed with axially extending slots in a portion which protrudes from the forward end of the socket so that a certain part of the quenching gases will radially escape through said slots. If a radial escape of a major part of the quenching gases is desired, the sleeve will be designed to closely surround not only the contact pin but also the socket so that a major part of the quenching gases will be compelled to flow through the axially extending slots. Outside the slotted sleeve the flow of the quenching gases will be less restricted in that case than where an unslotted sleeve is provided but the sleeve will prevent in any case a deposition of soot on those portions of the socket and pin which are covered by the sleeve.

The region in which soot can be deposited can be restricted not only by a non-slotted sleeve but can be similarly restricted by a slotted sleeve if the slotted sleeve is surrounded with a clearance by another sleeve, which is non-slotted.

BRIEF DESCRIPTION OF THE DRAWING

FIG. 1 is a longtudinal sectional view an electric power circuit breaker in a closed position.

FIG. 2 is a similar view showing the same breaker in an open position.

FIG. 3 is a longitudinal sectional view showing a different electric power circuit breaker in a closed position; that breaker comprises a sleeve for guiding the quenching gases.

FIG. 4 shows the breaker of FIG. 3 in an open position, in which the contact pin has been only partly retracted.

FIG. 8 is a longitudinal sectional view showing a fourth electric power circuit breaker in an open position.

FIG. 9 is a longitudinal sectional view showing a fifth electric power circuit breaker in a closed position.

FIG. 10 shows the breaker of FIG. 9 in an open position.

FIG. 11 is a longitudinal sectional view showing a sixth electric power circuit breaker in a closed position.

FIG. 12 shows the breaker of FIG. 11 in an open position.

DETAILED DESCRIPTION OF THE PREFERRED EMBODIMENTS

Figure 5:
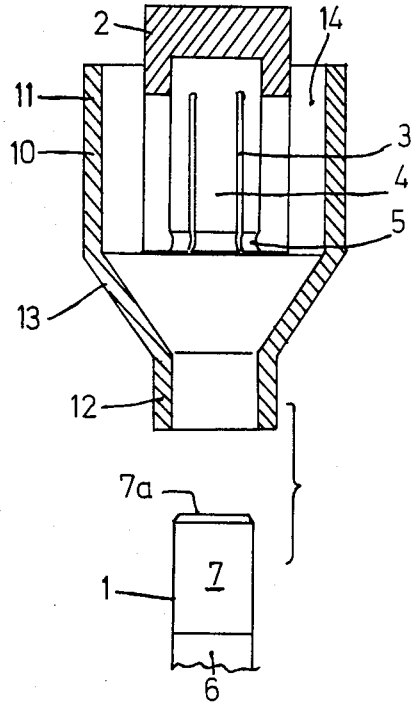
FIG. 5 shows the braker of FIG. 3 with the fully retracted contact pin.

Illustrative embodiments of the invention are diagrammatically shown on the accompanying drawing and will now be described more in detail.

Identical or corresponding parts of the various illustrative embodiments will be designated with the same reference characters.

The electric power circuit breaker shown in FIGS. 1 and 2 comprises a cylindrical contact pin 1 and a tulip-shaped contact socket 2, which is coaxial to the pin 1 and which in its forward portion, i.e., the portion which is adjacent to the pin when the breaker is open, is formed with axial slots 3 dividing that portion into axially extending segments 4. Each segment 4 is formed at the tip of the socket with a radially inwardly projecting convex portion 5, which resiliently bears on the peripheral surface of the pin 1 when the breaker is closed as is shown in FIG. 1.

The pin 1 is divided in length into two portions 6 and 7. The rear portion 6, i.e., the portion which is remote from the socket when the breaker is open, consists of a conventional contact material of high electrical conductivity, such as copper. The forward portion 7 of the pin, i.e., that portion which is adjacent to the socket when the breaker is open, consists of a composite material, which comprises a metal of high electrical conductivity, such as copper, as well as a material which will release quenching gases under the action of an electric arc.

That forward portion 7 of the pin 1 has a length which is smaller than the depth to which the pin can be inserted into the socket. As a result, the pin 1 will be contacted by the convex portions 5 of the socket 2 at its rear portion 6 rather than at its forward portion 7 when the pin has been fully inserted into the socket to a closed position defined by suitable stop means, as is shown in FIG. 1.

As a result, the composite material provided in the portion 7 of the pin will not carry current continuously. To open the breaker the pin 1 is retracted out of the socket 2. That action may result in the striking of an electric arc between the pin 1 and the socket 2. One end of that electric arc will be disposed at the portion 7, particularly at its end face 7*a*, because the portion 7 of the pin has such a composition that it can conduct electric current. Quenching gases will be released by the composite material of the portion 7 of the pin adjacent to the locations of the end of the electric arc and will flow toward the socket 2 and partly along its outside surface and will partly flow into the socket 2 and leave the same through the slots 3 and through an axial bore 8 formed in the rear end wall 2*a* of the socket.

In the illustrative embodiment shown in FIGS. 3 to 5 the electric power circuit breaker comprises as in the first embodiment a contact pin 1 and an axially slotted contact socket 2. A difference from the first embodiment resides in that the socket 2 is closed at its rear end. The socket 2 and the pin 1 are surrounded by a sleeve 10, which comprises a cylindrical portion 11, which is relatively large in diameter, a cylindical portion 12, which is relatively small in diameter, and a conical intermediate portion 13. The sleeve 10 is coaxial to the pin 1 and to the socket 2 and its portion 11 surrounds the socket 2 with a clearance so that the socket 2 and the sleeve 10 define between them an annular passage 14. The narrower portion 12 of the sleeve is closely spaced around the pin 1. The sleeve 10 is non-displaceable relative to the socket 2.

In the closed position of the power circuit breaker the tip of the pin 1 bears on the rear end wall 2*a* of the socket 2 and the convex portions 5 of the socket 2 contact the pin 1 in its region 6, which does not contain arc-quenching substances. As the pin 1 is retracted from the socket 2, an arc may be struck, must as in the first embodiment, between the portion 7 of the pin 1 and the socket 2 and that arc will cause quenching gases to be released by the pin 1. But in the second embodiment said quenching gases will flow mainly in an axial direction through the annular passage 14 so that the electric arc will be quenched quickly. Because the pin 1 is closely surrounded by the sleeve 10 the electric arc cannot jump back onto the portion 6 which has a high electrical conductivity.

In the open position of the power circuit breaker shown in FIG. 3 the pin 1 might be in a position in which that pin 1 is still surrounded by the sleeve 10, as is shown in FIG. 4. A higher electric strength will be obtained, however, if the break between the socket 2 and the pin 1 is increased in that the pin 1 is retracted to an end position, such as is shown in FIG. 5.

Figure 6:
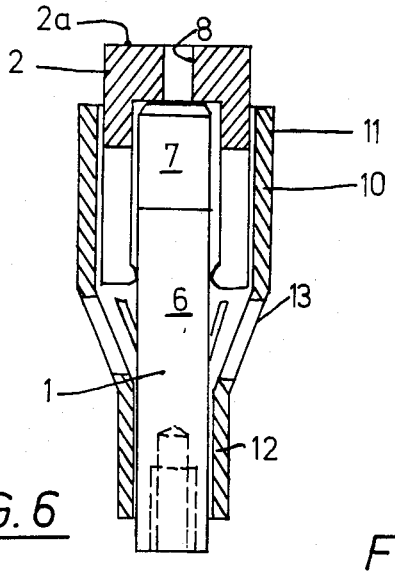
FIG. 6 is a longitudinal sectional view showing a third electric power circuit braker in a closed position.
Figure 7:
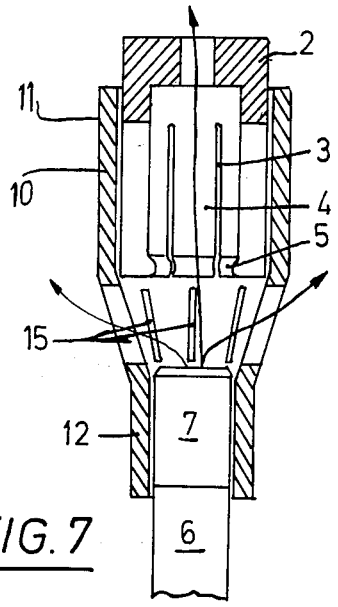
FIG. 7 shows the breaker of FIG. 6 in a closed position.

The illustrative embodiment shown in FIGS. 6 and 7 differs from the preceding embodiment in that the sleeve 10 closely surrounds not only pin 1 but also the socket 2. The conical portion 13 of the sleeve 10 is formed with longitudinal slots 15, through which a major part of the quenching gases can escape. A small part of the quenching gases can still blow through the constricted annular passage 14 defined between the sleeve 10 and the socket 2, and another part of the quenching gases enters the socket 2 and leaves it through the axial bore 8 in its rear end wall 2*a*. It will be understood that in the third embodiment the pin 1 may be retractable to a position in which the break between the pin 1 and the socket 2 is as large as shown in FIG. 5.

In all embodiments, the electric arc will be quenched quickly and the quenching gases will flow off rapidly and the directed flow of the quenching gases will restrict the deposition of soot to small areas.

The power circuit breaker shown in FIG. 8 differs from the one shown in FIGS. 6 and 7 in that the sleeve 10 for guiding the quenching gases along the arc column does not surround tha socket 2 but terminates at a small distance from the socket 2. The sleeve 10 is a cylindrical and closely surrounds the pin 1 even when the breaker is closed. The sleeve may be formed with axial slots in its forward portion, i.e., in that portion which is adjacent to the socket 2.

The power circuit breaker shown in FIGS. 9 and 10 is similar to the one shown in FIGS. 3 to 5 and differs from it only in the design of the sleeve 10. That portion of the sleeve 10 which portrudes from the socket 2 is divided into an annular series of generally longitudinally extending fingers 10*a*, which in the closed breaker resiliently bear on the peripheral surface of the pin 1. As the pin 1 is retracted from the socket 2 and subsequently from the sleeve 10 to open the breaker, the fingers 10*a* will spring radially inwardly to the position shown in FIG. 10, in which the annular series of fingers 10*a* constitutes a venturi like structure. As a result, the flow area for the quenching gases released under the action of the electric arc from the forward portion 7 of the contact pin 1 will be restricted and the quenching gases will be intensely blown against the electric arc. The annular series of fingers 10*a* now constitute a funnel, which at its small end faces the pin 1 and has a sufficiently large opening to permit the pin 1 to be inserted into the funnel so as to spread the fingers 10*a* apart when it is desired to close the breaker.

Just as in the embodiment shown in FIGS. 9 and 10, the sleve 10 provided in the illustrative embodiment shown in FIGS. 11 and 12 to guide the quenching gases comprises an annular series of fingers 10*a*, which resiliently bear on the pin 1 when the breaker is closed. A difference from the embodiment shown in FIGS. 9 and 10 resides in that the sleeve 10 is not fixed to the socket 2 but mounted on the pin for an axial displacement between stop 16 and 17 provided on the pin and will be carried along by the pin 1 after a lost motion limited by said stops. When the breaker is closed the fingers 10*a* of the sleeve 10 engage the tip of the socket 2. As the pin 1 is retracted from the socket 2 to open the breaker the pin will initially be retracted also relative to the sleeve 10 so that the annular series of fingers 10*a* will be progressively constricted between the pin 1 and the socket 2 until the forward stop 17 of the pin 1 engages a rim 18 of the sleeve 10 so that the latter will then be retracted too. This embodiment is particularly desirable for power circuit breakers in which there is large breakance between the socket 2 and the pin 1 when the breaker is opened. Because the sleeve 10 is retracted with the pin 1 moving to open the breaker, the quenching gases released at the tip of the pin 1 will be guided to the electric arc with the same intensity even when the break is large. As the pin 1 is advanced to close the breaker, the pin 1 spreads the fingers 10*a* apart and moves through the sleeve 10 into the socket 2. In the embodiments shown in FIGS. 9 to 12 the sleeve 10 is desirably made from a gently resilient plastic, which is also capable of releasing quenching gases, under the action of an electric arc.

We claim:

1. In an electric power circuit breaker comprising
a contact pin having a longitudinal axis and
a contact socket, which is coaxial to and adapted to receive said pin, wherein
said pin is axially movable relative to said socket between forward and rear end positions in which the breaker is closed and open, respectively,
said socket has a forward position which terminates in a socket tip and which is disposed adjacent to said pin in said rear end position and formed with a plurality of axially extending, resilient segments and with axially extending slots separating said segments, and
each of said segments is formed at said socket tip with a convex portion, which protrudes radially inwardly and is arranged to resiliently bear on said pin in said forward end position,
said pin is adapted to extend into said socket in a predetermined length beyond said convex portions in said forward end position,
the improvement residing in that
said pin comprises a forward position which comprises a pin tip and which in said rear end position is adjacent to said socket and which consists at least on its outside surface of a composite material comprising an electrically conductive metal and a gas-releasing material adapted to release quenching gases under the action of an electric arc so that said gases are adapted to cool said electric arc,
said forward portion of said pin has a length that is smaller than said predetermined length, and
a sleeve is provided, which is coaxial to said pin and said socket and arranged to surround said pin in said forward end position, said sleeve being electrically insulated from said socket, said sleeve having tapered walls adjacent said resilient segments for channeling outwardly the quenching gases through said slotted socket and about said socket.

2. The improvement set forth in claim 1, as applied to medium-voltage switchgear.

3. The improvement set forth in claim 1, wherein said socket is formed with an axial through bore.

4. The improvement set forth in claim 1, wherein said pin tip is arranged to protrude from said sleeve in said forward end position and to be disposed in said sleeve in said rear end position.

5. The improvement set forth in claim 1, wherein said sleeve is fixed to said socket and extends along and is spaced around said socket at least in part of the length of said socket and protrudes beyond said socket tip, said sleeve has a forward end portion arranged to surround said forward portion of said pin throughout the length of said forward portion of said pin in said rear end position, said forward end portion of said sleeve has an inside diameter which is only slightly in excess of the diameter of said pin.

6. The improvement set forth in claim 1, wherein
said sleeve has an end portion, which faces and is axially spaced from said socket tip, and
said end portion of said sleeve comprises a plurality of longitudinally extending, resilient fingers which are radially inwardly biased and arranged to bear on said pin in said forward end position and to clear said pin in said rear end position.

7. The improvement set forth in claim 6, wherein
said pin provided with two axially spaced apart stops and
said sleeve is axially slidably mounted on said pin for a lost motion limited by said stops.

8. The improvement set forth in claim 1, wherein said sleeve consists at least on its inside surface of a material which is adapted to release arc-quenching gases under the action of an electric arc.

9. The improvement set forth in claim 8, wherein said sleeve consists of said arc-quenching material.

10. The improvement set forth in claim 8, wherein said sleeve is coated on its inside surface with said arc-quenching material.

11. The improvement set forth in claim 1, wherein said sleeve is formed with a plurality of longitudinally extending apertures, which are axially spaced from said socket and disposed adjacent to said socket tip.

12. The improvement set forth in claim 11, wherein said apertures consist of slots.

13. The improvement set forth in claim 11, wherein said socket has a portion which extends along and is closely spaced around said socket.

14. In an electric power circuit breaker comprising
a contact pin having a longitudinal axis and
a contact socket, which is coaxial to and adapted to receive said pin, wherein
said pin is axially movable relative to said socket between forward and rear end positions in which the breaker is closed and open, respectively,
said socket has a forward portion which terminates in a socket tip and which is disposed adjacent to said pin in said rear end position and formed with a plurality of axially extending, resilient segments and with axially extending slots separating said segments, and
each of said segments is formed at said socket tip with a convex portion, which protrudes radially inwardly and is arranged to resiliently bear on said pin in said forward end position,
said pin is adapted to extend into said socket in a predetermined length beyond said convex portions in said forward end position,
the improvement residing in that
said pin comprises a forward portion which comprises a pin tip and which in said rear end position is adjacent to said socket and which consists at least on its outside surface of a composite material comprising an electrically conductive metal and a gas-releasing material adapted to release quenching gases under the action of an electric arc so that said gases are adapted to cool said electric arc, said forward portion of said pin has a length that is smaller than said predetermined length, a sleeve is provided, which is coaxial to said pin and said socket and arranged to surround said pin in said forward end position, said sleeve being electrically insulated from said socket, said sleeve has an end portion, which faces and is axially spaced from said socket tip, and said end portion of said sleeve comprises a plurality of longitudinally extending, resilient fingers which are radially inwardly biased and arranged to bear on said pin in said forward end position and to clear said pin in said rear end position.

15. The improvement set forth in claim 14, wherein said pin is provided with two axially spaced apart stops, and said sleeve is axially slidably mounted on said pin for a lost motion limited by said stops.

16. The improvement set forth in claim 14, wherein said sleeve is formed with a plurality of longitudinally extending apertures, which are axially spaced from said socket and disposed adjacent to said socket tip.

17. The improvement set forth in claim 16, wherein said apertures consist of slots.

18. The improvement set forth in claim 1, wherein said pin tip in the forward position is flat topped.

* * * * *